US009038925B2

(12) United States Patent
North et al.

(10) Patent No.: US 9,038,925 B2
(45) Date of Patent: May 26, 2015

(54) BALL SHAPED WATER SPRINKLER SYSTEM

(71) Applicants: Michael North, Parachute, CO (US); Dehlia Dodd, Parachute, CO (US)

(72) Inventors: Michael North, Parachute, CO (US); Dehlia Dodd, Parachute, CO (US)

( * ) Notice: Subject to any disclaimer, the term of this patent is extended or adjusted under 35 U.S.C. 154(b) by 0 days.

(21) Appl. No.: 13/774,618

(22) Filed: Feb. 22, 2013

(65) Prior Publication Data

US 2014/0239093 A1 Aug. 28, 2014

(51) Int. Cl.

| | |
|---|---|
| ***B05B 3/06*** | (2006.01) |
| ***B05B 13/04*** | (2006.01) |
| ***B05B 3/04*** | (2006.01) |

(52) U.S. Cl.

CPC ..... *B05B 13/04* (2013.01); *B05B 3/0409* (2013.01)

(58) Field of Classification Search

CPC ..... B08B 3/026; A01M 7/0035; A01G 25/09; A01G 25/097; B05B 3/00; B05B 3/06; B05B 3/16; B05B 3/02; B05B 13/04; B05B 13/0421; B05B 3/0404

USPC ..... 239/722, 211, 289, 744, 747, 754, 239/222.15, 251, 242

See application file for complete search history.

(56) References Cited

U.S. PATENT DOCUMENTS

| | | | | |
|---|---|---|---|---|
| 2,607,625 | A * | 8/1952 | Salmonese | 239/248 |
| 2,788,241 | A * | 4/1957 | Jepson | 239/67 |
| 3,700,172 | A * | 10/1972 | Gallegos, Sr. | 239/722 |
| 4,274,591 | A * | 6/1981 | Sunshine et al. | 239/722 |
| 6,558,223 | B1 * | 5/2003 | Matthews | 446/153 |

* cited by examiner

*Primary Examiner* — Dinh Q Nguyen

(74) *Attorney, Agent, or Firm* — The Law Office of Jerry D. Haynes

(57) ABSTRACT

A traveling sprinkler system comprising: a sphere shaped surface; at least one wheel over a circumference of the sphere shaped surface, where the at least one wheel divides the sphere into a first half and a second half; a plurality of holes on both the first half and the second half of the sphere shaped surface; a water hose receptacle, where the water hose receptacle receives a flow of water from a water hose; and wheel gears within the sphere, where the flow of water transfers over the wheel gears to enable the movement of the at least one wheel and the flow of water transfers through the plurality of holes creating a sprinkling action.

4 Claims, 1 Drawing Sheet

BALL SHAPED WATER SPRINKLER SYSTEM

BACKGROUND OF THE INVENTION

1. Field of Invention

The present invention relates to a water sprinkler that provides a unique shape and mobility features to provide a unique water sprinkler 2. Description of Related Art Water sprinklers are used in various applications to provide water to lawns, gardens, parks, golf courses and other fields of application. Many times sprinklers are necessary to provide water to a recreational area, vegetation or in some instances to control dust. Consequently the sprinklers provide a water source for the vegetation or lawns and insure that the surface area remains properly hydrated for optimum growth.

One particular application for sprinklers relates to traveling sprinklers that travel across the surface of a lawn based upon the transmission of water pressure through the sprinkler Normally the traveling sprinkler has a conventional sprinkler arm, gears and transmission that receive a flow of water from a hose. As the water pressure transfers through the sprinkler, force is applied to the gears that enable the movement of the traveling sprinkler through and around a particular surface of land. Conventional traveling sprinklers are normally in a tractor style model where wheels are provided on the base and it is configured in a tractor shape with at least three wheels.

SUMMARY OF THE INVENTION

The present invention relates to a traveling sprinkler system comprising: a sphere shaped surface; at least one wheel over a circumference of the sphere shaped surface, where the at least one wheel divides the sphere into a first half and a second half; a plurality of holes on both the first half and the second half of the sphere shaped surface; a water hose receptacle, where the water hose receptacle receives a flow of water from a water hose; and wheel gears within the sphere, where the flow of water transfers over the wheel gears to enable the movement of the at least one wheel and the flow of water transfers through the plurality of holes creating a sprinkling action.

DETAILED DESCRIPTION

The present invention relates to a ball-shaped water sprinkler that traverses across a surface area where the sprinkler provides a flow of water over the traveled surface area. The water sprinkler system according to the present invention is a ball-shaped type of traversing water sprinkler that includes wheels over the circumference of the ball and a sprinkler outlet on both sides of the ball providing a flow of water through the sprinklers. The sprinkler system according to the present invention further include gears related to movement of sprinkler arteries within the ball and movement of the wheels that enable the movement of the sprinkler system over the surface area.

Figure 1:
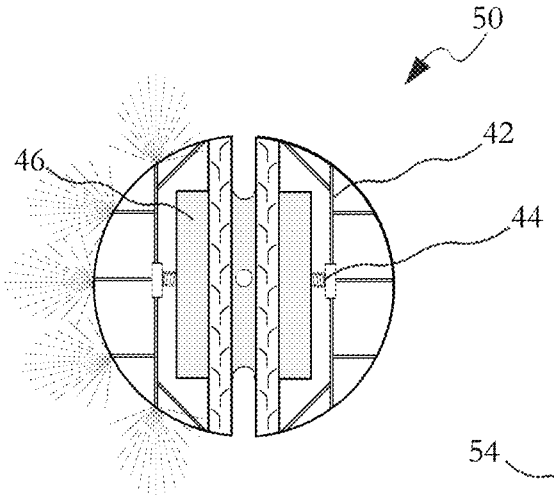
FIG. 1 shows a view of the internal gears associated with a ball-shaped water sprinkler system in accordance with the present invention.

FIG. 1 depicts a view of the internal components of a ball-shaped water sprinkler system 50 in accordance with the present invention. The ball-shaped sprinkler system 50 includes sprinkler arteries 42 that disperse water through holes provided in the surface area of the sprinkler system. The sprinkler arteries 42 have a base 44, as depicted in both sides of the sphere, which connects to gears shown in FIG. 3. The gears provide the movement of arteries 42 that connect to sprinkler openings and movement of wheels 54, shown in FIG. 2. A box hose receptacle 46 is also depicted in FIGS. 1 and 3. The hose receptacle 20 receives a connection to a water hose that provides a flow of water through the ball-shaped sprinkler system 50.

Figure 2:
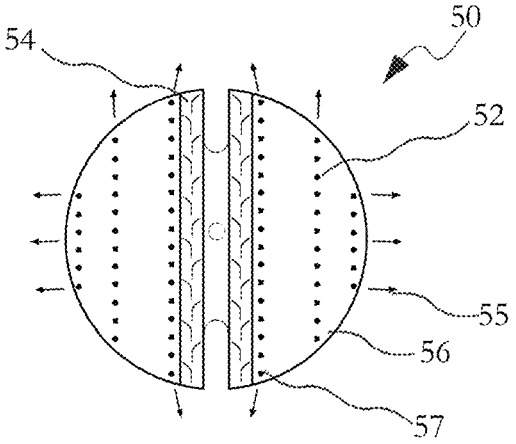
FIG. 2 depicts the sprinkler surface area in accordance with the present invention.
Figure 3:
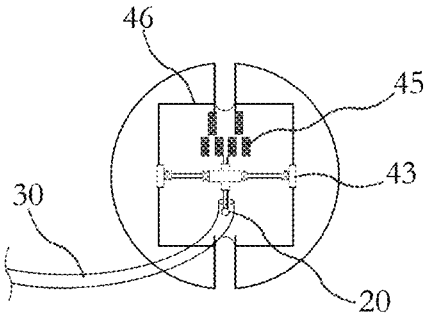
FIG. 3 depicts gears associated with the wheel and sprinklers within the ball-shaped water sprinkler system according to the present invention.

The wheels 54 depicted in FIG. 2 travel across the circumference of the ball-shaped sprinkler system 50. The wheels 54 provide for the movement of the ball-shaped water sprinkler system 50 across a surface area or upon the ground. Further shown in FIG. 2 is a sprinkler surface 52, which comprises the entire outer surface of the ball-shaped sprinkler system 50. The sprinkler surface 52 includes holes 55, 56, 57, mirrored on each side of the system 50, which release water provided by the sprinkler arteries 42 under the sprinkler surface 52. Arrows depict the movement of the water from the sprinkler arteries 42 through the holes 55, 56, 57. Although three rows of holes 55, 56, 57 are depicted in FIG. 2, a multitude of holes may be provided in additional rows or other configurations that will be suitable for the emission of water there through.

FIG. 3 depicts a view of the internal components of the box hose receptacle 46. A set of wheel gears 45 are provided in the box hose receptacle 46 for movement of the wheels 54 in a circular motion. Further, a set of sprinkler gears 43 are provided for movement of the sprinkler arteries 42 within the internal area of the sprinkler surface 52. A water hose receptacle 20 is also shown which receives a flow of water from a water hose 30 into both sprinkler gears 43 and the wheel gears 45. During use, water pressure provided through the hose 30 activates the movement of wheel gears 45 and the sprinkler gears 43 to move the wheels 54 and the sprinkler arteries 42, respectively, in order to create an active sprinkling system for the ball-shaped sprinkler system 50.

The ball-shaped sprinkler system 50 according to the present invention creates a moving sphere that transfers across a surface area providing an even consistent flow of water. The flow of water may be set to a desired sprinkler setting. Further independent gears are provided for both the sprinkler mechanism and the exterior wheels over the circumference of the ball-shaped sprinkler system 50. The advantage of this particular traversing sprinkler system is the ability to make difficult maneuverable turns that are not possible with other types of traveling sprinkler systems. The ball-shaped sprinkler system 50 may have adjustable settings, to speed up or slow down the movement of the wheels 54 upon the ground. The instant invention has been shown and described in what it considers to be the most practical and preferred embodiments. It is recognized, however, that departures may be made there from within the scope of the invention and that obvious modifications will occur to a person skilled in the art.

What is claimed is:

1. A traveling sprinkler system comprising:

a. a sphere shaped surface;

b. at least one wheel over a circumference of the sphere shaped surface, where the at least one wheel divides the sphere into a first half and a second half;

c. a plurality of holes on both the first half and the second half of the sphere shaped surface, an artery associated with each hole, wherein the artery is within the sphere extending from a base;

d. a water hose receptacle, where the water hose receptacle receives a flow of water from a water hose; and e. a set of wheel gears within the sphere, where the flow of water transfers over the wheel gears to enable the movement of the at least one wheel and the flow of water transfers through the plurality of holes creating a sprinkling action.

2. The traveling sprinkler system according to claim 1, further including a set of sprinkler gears associated with the arteries, where the flow of water transfers over the sprinkler gears associated with the arteries.

3. The traveling sprinkler system according to claim 1, where the sphere shaped surface is divided by two wheels.

4. The traveling sprinkler system according to claim 1, where the plurality of holes are arranged in rows across each half sphere of the spherical surface.

* * * * *